US005841327A

United States Patent [19]

Gerstenberg et al.

[11] Patent Number: 5,841,327

[45] Date of Patent: Nov. 24, 1998

[54] ELECTRICALLY SWITCHED MULTIPORT MICROWAVE LAUNCHER

[75] Inventors: John W. Gerstenberg, Lake Elsinore; Ken W. Brown, Yucaipa, both of Calif.

[73] Assignee: Raytheon Company, El Segundo, Calif.

[21] Appl. No.: 612,989

[22] Filed: Mar. 8, 1996

[51] Int. Cl.[6] ..... H01P 1/14

[52] U.S. Cl. ..... 333/101; 333/99 PL; 333/258

[58] Field of Search ..... 333/13, 99 PL, 333/101, 103, 108, 125, 137, 258

[56] References Cited

U.S. PATENT DOCUMENTS

| | | | |
|---|---|---|---|
| 2,415,242 | 2/1947 | Hershberger | 333/258 X |
| 2,644,926 | 7/1953 | Varela | 333/101 |
| 2,892,983 | 6/1959 | Larson | 333/13 |
| 2,941,166 | 6/1960 | Meyer | 333/125 |
| 3,155,925 | 11/1964 | Wantuch | 333/258 X |
| 3,178,659 | 4/1965 | Smith et al. | 333/103 |
| 3,324,420 | 6/1967 | Blachier et al. | 333/101 |
| 4,302,734 | 11/1981 | Stockton et al. | 333/104 |
| 5,502,354 | 3/1996 | Correa et al. | 315/111.01 |

FOREIGN PATENT DOCUMENTS 1 125.450A 10/1956 France .

*Primary Examiner*—Paul Gensler
*Attorney, Agent, or Firm*—Brian C. Downs; Leonard A. Alkov; Glenn H. Lenzen, Jr.

[57] ABSTRACT

A microwave launcher includes a hollow microwave cavity in the shape of a plus sign, four coplanar exit ports in the arms of the microwave cavity, and a non-coplanar entry port at a central hub of the microwave cavity. A single magnetron is in communication with the entry port. There is a controllable, electrically activated microwave barrier at each of the exit ports. Each microwave barrier includes an electrical signal input whose operation controls the activation of the microwave barrier. A switching circuit has a voltage source for the electrical signal input of each of the microwave barriers. Microwave power output from the single microwave source is launched from the selected exit port by using the switching circuit to selectively block microwave passage through each of the nonselected exit ports, but to leave the selected exit port unblocked.

25 Claims, 6 Drawing Sheets

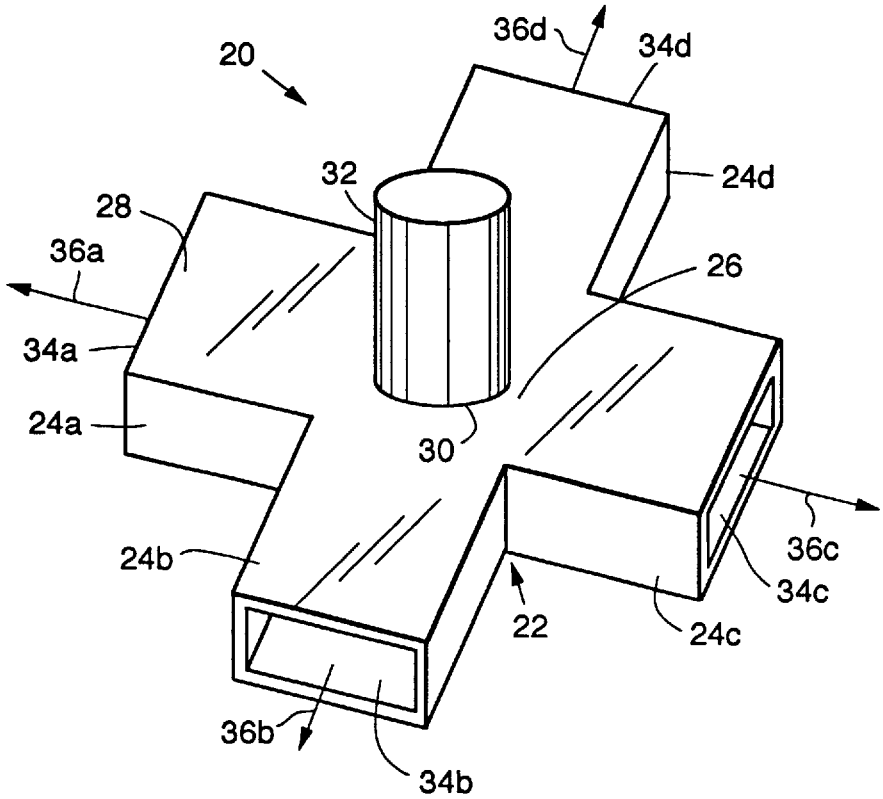
FIG. 1
FIG. 2
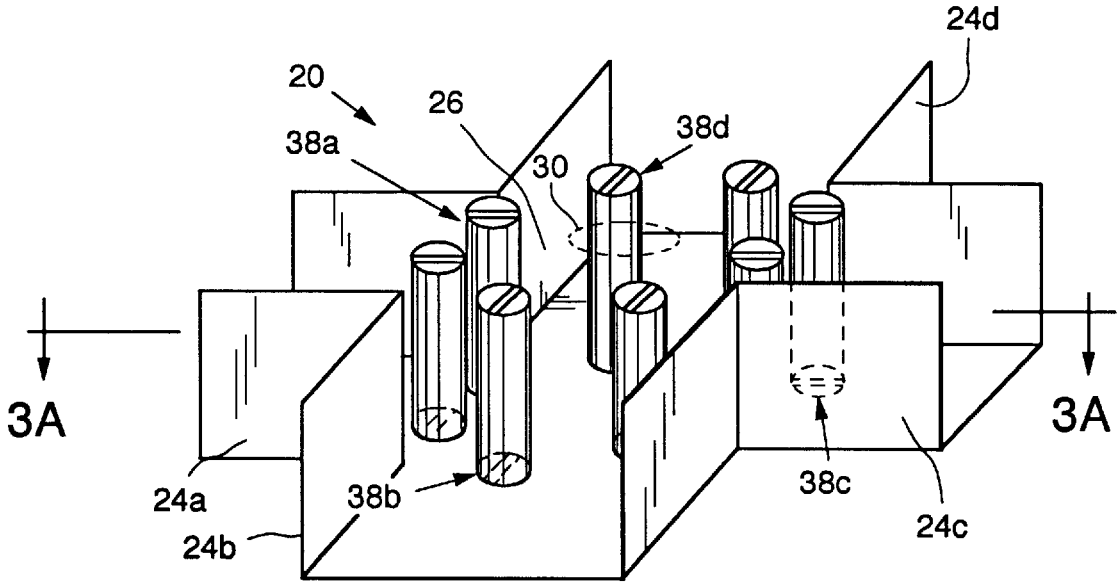

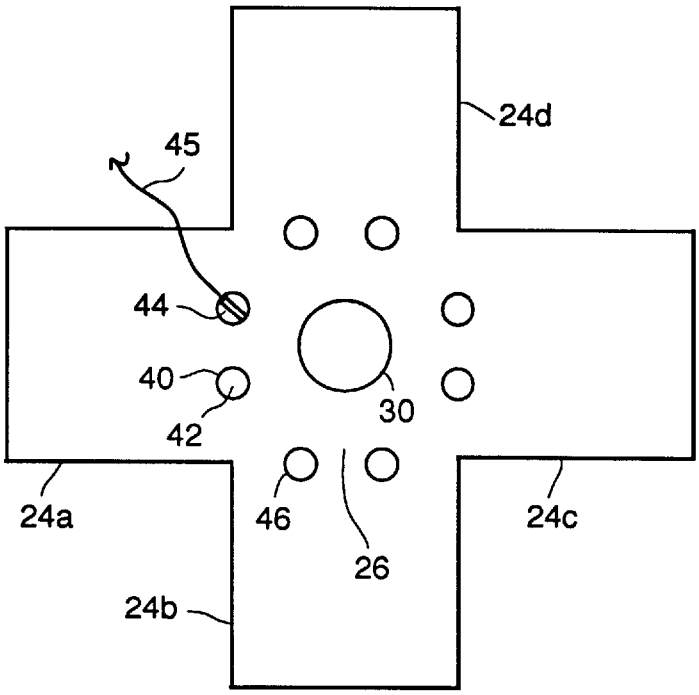
FIG. 3A
FIG. 3B
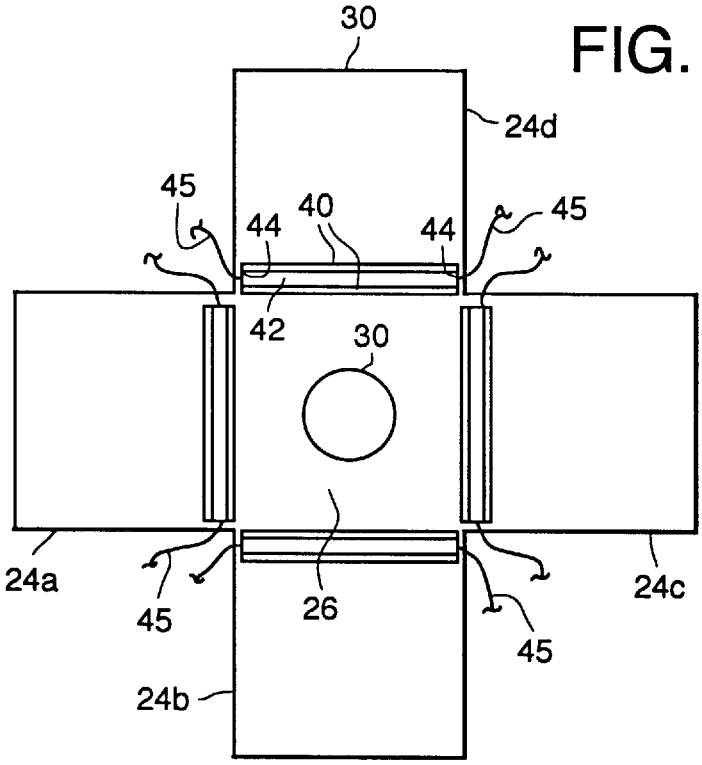

ELECTRICALLY SWITCHED MULTIPORT MICROWAVE LAUNCHER

BACKGROUND OF THE INVENTION

This invention relates to microwave devices, and, more particularly, to a multiport microwave launcher that controllably projects microwaves from multiple ports.

High-power microwave signals are generated by a microwave source such as a monopole radiator of the magnetron type. The microwave energy is coupled from the source into a waveguide and possibly into free space as a microwave beam, using a device termed a microwave launcher. The generation of a single microwave signal from a single microwave source is well known.

Some applications require the capability to generate and select between multiple microwave signals. For example, it may be necessary to spatially scan the microwave signals in a controllable manner. The first microwave signal is directed in a first direction, the second microwave signal is directed in a second direction, and so on. Rapid but controllable switching between the multiple microwave signals is necessary in some circumstances.

One possible approach to producing a scanned microwave beam is to provide a single magnetron and to steer the waveguide output by mechanically pointing the magnetron and its output waveguide in the desired direction. This approach is far too slow for typical scanning requirements. Another operable approach to providing scannable microwave signals is to use multiple magnetrons fixedly pointed in the required directions, one for each microwave signal, and to switch operation between the multiple magnetrons as needed. Because each magnetron, taken together with its associated support equipment, is rather heavy, this approach leads to a high overall system weight. In another approach, electromagnetic microwave switches, based upon a ferrite circulator principle, have been developed to permit the output of a single magnetron travelling through a waveguide to be switched between two exit ports of the waveguide. The output of each of the two exit ports can be used as an input to a further electromagnetic switch, permitting a total of four switched microwave signals using a single magnetron and three electromagnetic switches. This technique results in significantly reduced system weight as compared with the use of multiple magnetrons because only a single magnetron is required, and is useful for many applications. However, the switching time is typically on the order of 5–10 milliseconds and is therefore too slow for applications requiring the ability to scan between output directions in less than one millisecond, and typically in the range of a few microseconds or so. The required signal drive currents for the electromagnets is large, limiting the pulse-to-pulse microwave output rate.

There is a need for an improved microwave launcher system wherein multiple output signals are generated in a scannable manner. Reduced drive power consumption and increased port-to-port switching speeds, as compared with available systems, are also needed. The present invention fulfills this need, and further provides related advantages.

SUMMARY OF THE INVENTION

The present invention provides a high-power microwave launcher system with multiple microwave output signals. The microwave launcher uses a single microwave source and a single microwave cavity structure for coupling and switching the microwave energy between multiple ports. The maximum switching speed between the multiple ports is on the order of less than one millisecond, and typically in the microsecond range, far faster than possible with other multidirectional microwave launchers. The externally supplied drive switching power consumption of the microwave launcher system is relatively low. The weight, complexity, size, and cost of the microwave launcher are reduced as compared with other approaches, due to the use of a single microwave source and a single coupling and switching device.

In accordance with the invention, a microwave launcher comprises a hollow microwave cavity having an entry port and at least two exit ports, and a single microwave source having a source output in communication with the entry port of the microwave cavity. There is a controllable, electrically activated microwave barrier at each of the at least two exit ports. Each microwave barrier includes an electrical signal input whose activation controls the microwave barrier. A switching circuit includes a voltage source for the electrical signal input of each of the microwave barriers.

The microwave cavity is preferably in the form of a planar plus sign with four coplanar arms oriented at 90 degrees to each other, and with an exit port on each arm of the plus sign. The entry port is at the center of the plus sign and oriented perpendicular to the plane of the arms. The output of the microwave source is supplied to the entry port and controllably extracted at the individual exit ports.

The microwave barrier at each exit port is preferably in the form of a container, a volume of gas within the container, and an electrode contacting the volume of gas within the container. The container may be cylindrical, prismatic, planar, or other operable shape. When a voltage is applied to the electrode, the gas is ionized to form an electrically conducting plasma. The plasma acts in the manner of an electrically conducting wall that reflects microwave energy to prevent the entry of microwave energy into the exit port associated with the microwave barrier.

Switching of the output of the microwave launcher between the multiple exit ports is accomplished by producing such a microwave barrier at each of the exit ports which are not to pass the microwave energy at any moment and simultaneously not creating such a microwave barrier at the exit port from which the microwave energy is to be extracted. Thus, the switching circuit for a four-port launcher designed for one microwave output at a time includes four output subcircuits, each of which applies a plasma-creating voltage to the microwave barrier at each of the three exit ports not selected for output, but not applying a plasma-creating voltage to the microwave barrier at the exit port selected to produce the output. The switching circuit can scan between these multiple ports quite rapidly, with the maximum switching speed limited by the time required to create and eliminate the microwave barrier at each exit port. Studies have shown that the maximum switching speed is on the order of ten microseconds or less, and in some cases just a few microseconds.

The present invention provides a multiport microwave launcher with a high switching speed, but with low weight, drive power consumption, complexity, size, and cost. Other features and advantages of the present invention will be apparent from the following more detailed description of the preferred embodiment, taken in conjunction with the accompanying drawings, which illustrate, by way of example, the principles of the invention. The scope of the invention is not, however, limited to this preferred embodiment.

BRIEF DESCRIPTION OF THE DRAWINGS

FIG. 1 is an external perspective view of a four-exit-port microwave launcher;

FIG. 2 is a schematic perspective cutaway view of the microwave launcher of FIG. 1 with the magnetron removed so as not to obscure the internal structure;

FIG. 3A is a sectional view of the microwave launcher of FIG. 2, taken along lines 3—3 (perpendicular to the plane of the arms);

FIG. 3B is a sectional view of another embodiment of the microwave launcher of FIG. 2, in the same view as FIG. 3A;

DETAILED DESCRIPTION OF THE INVENTION

Figure 3C:
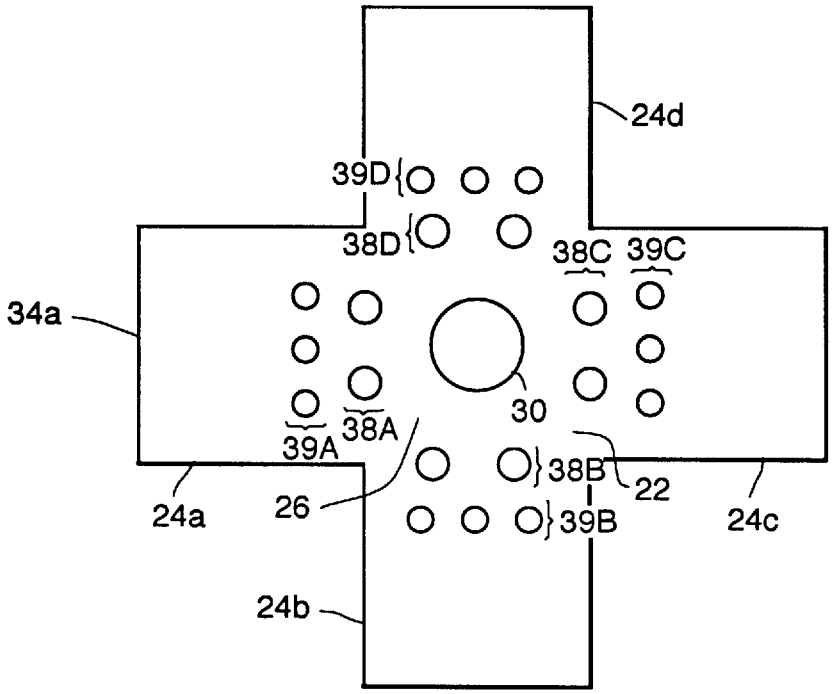
FIG. 3C is a sectional view of another embodiment of the microwave launcher of FIG. 2, in the same view as FIG. 3A.

FIG. 1 illustrates a multiport microwave launcher 20. The microwave launcher 20 includes a hollow microwave cavity 22. In the preferred form, the microwave cavity is in the form of a planar "plus" sign with four coplanar arms 24*a*, 24*b*, 24*c*, and 24*d* extending from a central hub 26 and equally spaced apart angularly from each other by 90 degrees in a plane 28 defined by the four arms 24 of the microwave cavity 22. There is a microwave entry port 30 at the hub 26 of the plus-shaped microwave cavity 22, oriented perpendicular to the plane 28. A microwave source has an output which communicates with the entry port 30. The microwave source is illustrated as a magnetron 32, which is a well known device in the art. There are at least two exit ports, and in the preferred form illustrated in FIG. 1 four exit ports 34*a*, 34*b*, 34*c*, and 34*d* corresponding to each of the four hollow arms 24*a*, 24*b*, 24*c*, and 24*d*. Arrows 36*a*, 36*b*, 36*c*, and 36*d* indicate the four respective propagated microwave beams from the four exit ports 34*a*, 34*b*, 34*c*, and 34*d*. As will be discussed subsequently, only one of these four propagated microwave beams 36 is controllably emitted from the microwave launcher at a time in the preferred application, although the microwave launcher 20 permits different propagated beams to be extracted at the same time in other applications.

FIG. 2 is an interior perspective view of the microwave launcher 20 of FIG. 1. The microwave cavity 22, including the arms 24 and hub 26, is hollow. A controllable, electrically activated microwave barrier 38*a*, 38*b*, 38*c*, and 38*d* is positioned at the entry to each of the exit ports 34*a*, 34*b*, 34*c*, and 34*d*, between the hub 26 and each of the respective arms 24*a*, 24*b*, 24*c*, and 24*d*. The microwave barriers 38 are individually and selectively activated. When any microwave barrier 38*a*, 38*b*, 38*c*, or 38*d* is activated, microwaves are reflected from the activated microwave barrier, effectively closing the respective exit port 34*a*, 34*b*, 34*c*, or 34*d* so that a substantial amount of microwave energy cannot enter the respective exit port. Microwave energy supplied through the entry port 30 does flow into any exit port whose respective microwave barrier is not activated.

The preferred microwave barrier 38 is a gas breakdown tube wherein the application of a high voltage to a confined gas produces an electrically conductive plasma within the tube. FIGS. 3A and 3B illustrate two preferred physical forms of the microwave barrier 38. In each case, the microwave barrier 38 includes a container 40 made of an electrically nonconductive material such as a ceramic, a volume of gas 42 within the container 40, and electrodes 44 contacting the volume of gas 42. Electrical leads 45 extend from the electrodes. In FIGS. 2 and 3A, the container 40 of the gas breakdown tube is in the form of an elongated hollow body, illustrated as a hollow cylinder 46, and there are two such hollow cylinders 46 that form each microwave barrier 38.

Figure 4:
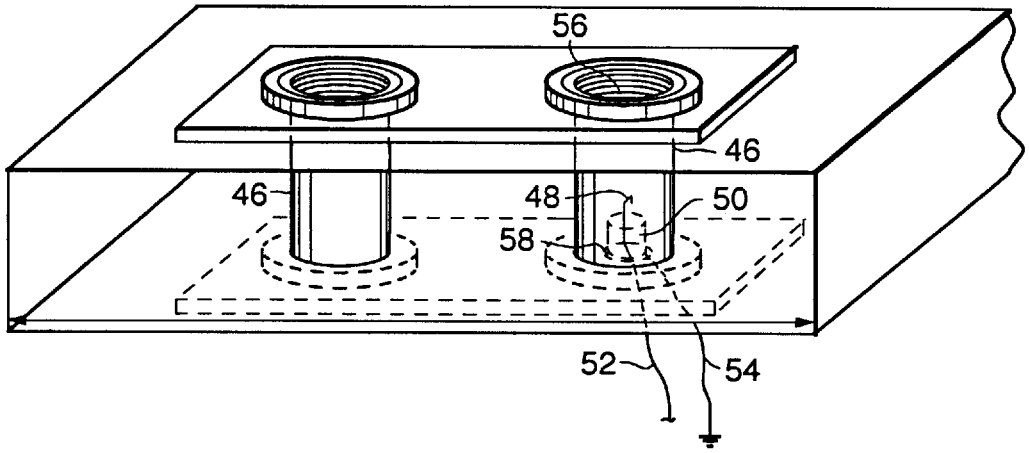
FIG. 4 is a perspective schematic view of a cylindrical microwave barrier of FIG. 3A utilizing two cylindrical elements, with the right cylinder shown in cutaway view to illustrate its interior structure.

FIG. 4 shows in greater detail the pair of cylinders 46 that constitute one of the microwave barriers. Each cylinder 46 has two electrodes 48 and 50, with respective electrical leads 52 and 54 extending therefrom. In the illustrated case, the electrodes 48, 50 are conveniently arranged in a spark-plug configuration, but other forms of the electrodes may be used. In the spark-plug configuration, one of the electrodes 50 (the outer electrode in the illustration) is typically grounded, and the other electrode 48 (the center electrode in the illustration) is controllably supplied with a positive voltage when the microwave barrier is to be activated. Each cylinder 46 has a gas entry port 56 at one end thereof, through which gas is supplied to the interior of the hollow cylinder. The other end 58 of the cylinder 46 may be closed or may include a gas flow path to permit the contained gas to flow through the cylinder 46. The gas within the cylinder may thus be in the form of either a dynamic or a Static atmosphere.

The gas 42 is preferably a noble gas such as neon, helium, argon, or xenon or a mixture thereof, provided at a reduced pressure, typically in the millitorr range, sufficient to sustain a plasma. To activate the gas breakdown tube, a voltage on the order of a few thousand volts is applied between the electrodes 48 and 50, resulting in the production of sufficient ultraviolet light to ionize the gas. The ionized gas produces a plasma within the cylinder 46. The plasma is electrically conductive, and therefore acts as a reflective surface for microwaves. When a sufficient voltage is applied between the leads 52 and 54, the pair of cylinders serves as the microwave barrier for the respective exit port. When no voltage is applied, microwaves pass into the exit port.

FIG. 3B depicts another embodiment of the microwave barrier 38. In this case, each microwave barrier 38 is in the form of a flat plate structure, wherein the container is defined by two flat plates filling most of the interior cross section of each of the exit ports 34, with electrodes 44 sealing the opposing ends of the plates together to form the closed container 40. The space within the container 40 is filled with the volume of gas 42, and leads 45 extend from the electrodes 44. The illustrated plate-like microwave barrier functions in substantially the same manner as the cylindrical microwave barrier of FIGS. 2, 3A, and 4.

The planar form of the microwave barrier as shown in FIG. 3B is superior to the cylindrical form from an efficiency standpoint. It presents to the microwave energy a large, continuous reflective barrier surface of controllable, uniform plasma depth, having a high microwave reflective efficiency. The cylindrical form of the microwave barrier illustrated in FIGS. 2, 3A and 4 has the practical advantage that it is more easily constructed and is less prone to gas leakage. For these reasons, the cylindrical form of the microwave barrier has been preferred during the developmental stages of the invention, although the planar form would likely be preferred for eventual applications. Other forms of the microwave barrier, such as hollow prisms, may also be used as desired.

According to microwave theory, for optimum performance the microwave barrier serving as the back wall for the exit port from which the microwave energy is extracted is desirably spaced a distance of $\lambda/4$ from the entry port 30, where $\lambda$ is the microwave wavelength. The side walls for the exit port from which the microwave is extracted are desirably spaced a distance greater than $\lambda/4$ from the entry port 30. These considerations are somewhat in conflict where it is desired to have the capability to extract microwave energy evenly from any of the exit ports.

Two solutions to this problem have been developed. In one, there is a single microwave barrier in each arm 24 and the microwave barriers are all spaced from the entry port a distance intermediate between the optimum back wall and side wall spacings. The waveguide width is one-half the microwave length in the waveguide cavity, or $(\frac{1}{2})^{1/2}$ times the free-space microwave wavelength.

FIG. 3C illustrates another solution using an embodiment having the four microwave barriers 38*a*, 38*b*, 38*c*, and 38*d*, as discussed previously, in this case depicted as cylindrical gas breakdown tubes of the type discussed previously. The microwave barriers 38 are each spaced by the optimum back wall distance from the entry port. Additionally, each arm 24 includes a respective second microwave barrier 39*a*, 39*b*, 39*c*, and 39*d*, positioned further from the entry port 30 than the respective microwave barriers 38*a*, 38*b*, 38*c*, and 38*d*. The second microwave barriers 39 would each be spaced by the optimum side wall distance from the entry port. The second microwave barrier is also depicted as a cylindrical breakdown tube, although it could be of a flat plate or other configuration. The second microwave barriers 39*a*, 39*b*, 39*c*, and 39*d* are shown as cylinders of different diameter than the cylinders of the microwave barriers 38*a*, 38*b*, 38*c*, and 38*d*, in this case a smaller diameter, illustrating the fact that the second microwave barriers 39 may be of different physical form than the microwave barriers 38. The second microwave barrier need not be of the same physical configuration as the first microwave barrier.

Each second microwave barrier 39 provides a controllably activated microwave-reflective surface at a greater distance from the entry port 30 than the microwave barrier 38. Any one of the microwave barriers 38 and its associated second microwave barrier 39 would be typically operated in the alternative. For example, if the second microwave barrier 39*d* is activated, the associated microwave barrier 38*d* would not be activated and would be transparent to microwaves. In one example, if microwaves were to be extracted from the exit port 34*a*, confinement of the microwaves within the hub 26 of the microwave cavity 22 would be achieved by activating the second microwave barriers 39*b* and 39*d* as the effective side wall barriers, and the microwave barrier 38*c* as the effective back wall barrier. In this way, the effective back wall (38*c*) relative to the exit port 34*a* would be at a lesser distance from the entry port 30 than the effective side walls (39*b* and 39*d*). In some cases, such a geometry may lead to reduced losses and improved efficiency, at the cost of greater complexity and weight of the microwave launcher.

Figure 5:
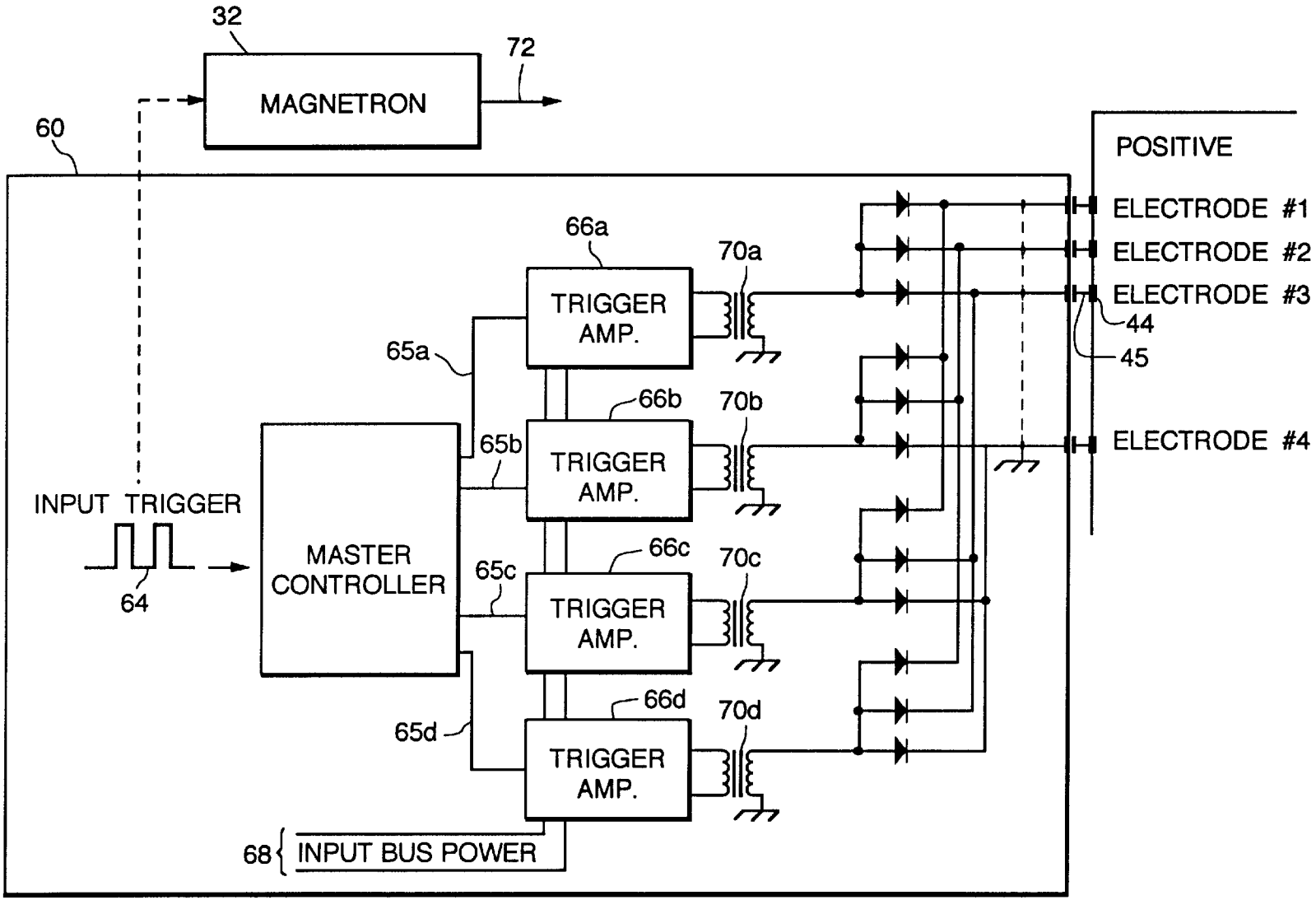
FIG. 5 is a block diagram of a switching circuit used in the microwave launcher.

A switching circuit 60 such as that depicted in FIG. 5 is provided as part of the microwave launcher 20. The output of the switching circuit 60 is connected to the electrical leads 45 (leads 52, 54 in FIG. 4) of the microwave barriers 38. The switching circuit 60 includes a master controller 62 which receives an input trigger signal 64 generated elsewhere, typically according to the requirements of the application in which the microwaves signals are used. In a scanning application, a pulse in the input trigger signal 64 indicates the shifting of the microwave output beam to the next direction. The trigger signal is also supplied to the magnetron 32.

The master controller 62 generates a sequence of port trigger signals 65*a*, 65*b*, 65*c*, and 65*d* (whose timing will be discussed subsequently in relation to FIG. 6) to respective trigger amplifiers 66*a*, 66*b*, 66*c*, and 66*d*, one for each of the respective microwave barriers 38*a*, 38*b*, 38*c*, and 38*d*. The trigger amplifiers 66 are supplied from an input bus power source 68. The voltage output of each trigger amplifier 66*a*, 66*b*, 66*c*, and 66*c* is boosted to the required voltage for ionizing the volume of gas 42 by a respective transformer 70*a*, 70*b*, 70*c*, and 70*d*, which are protected by diodes from interaction with the other transformers. The outputs of the transformers 70 are supplied to the positive electrodes of those microwave barriers which are to be made reflective of microwave energy and therefore not permit microwave energy to be passed into the respective exit port. For example, if microwave energy is to be extracted from exit port 34*a*, the voltages necessary to ionize the gases in the microwave barriers 38*b*, 38*c*, and 38*d* are applied by the switching circuit 62.

Figure 6:
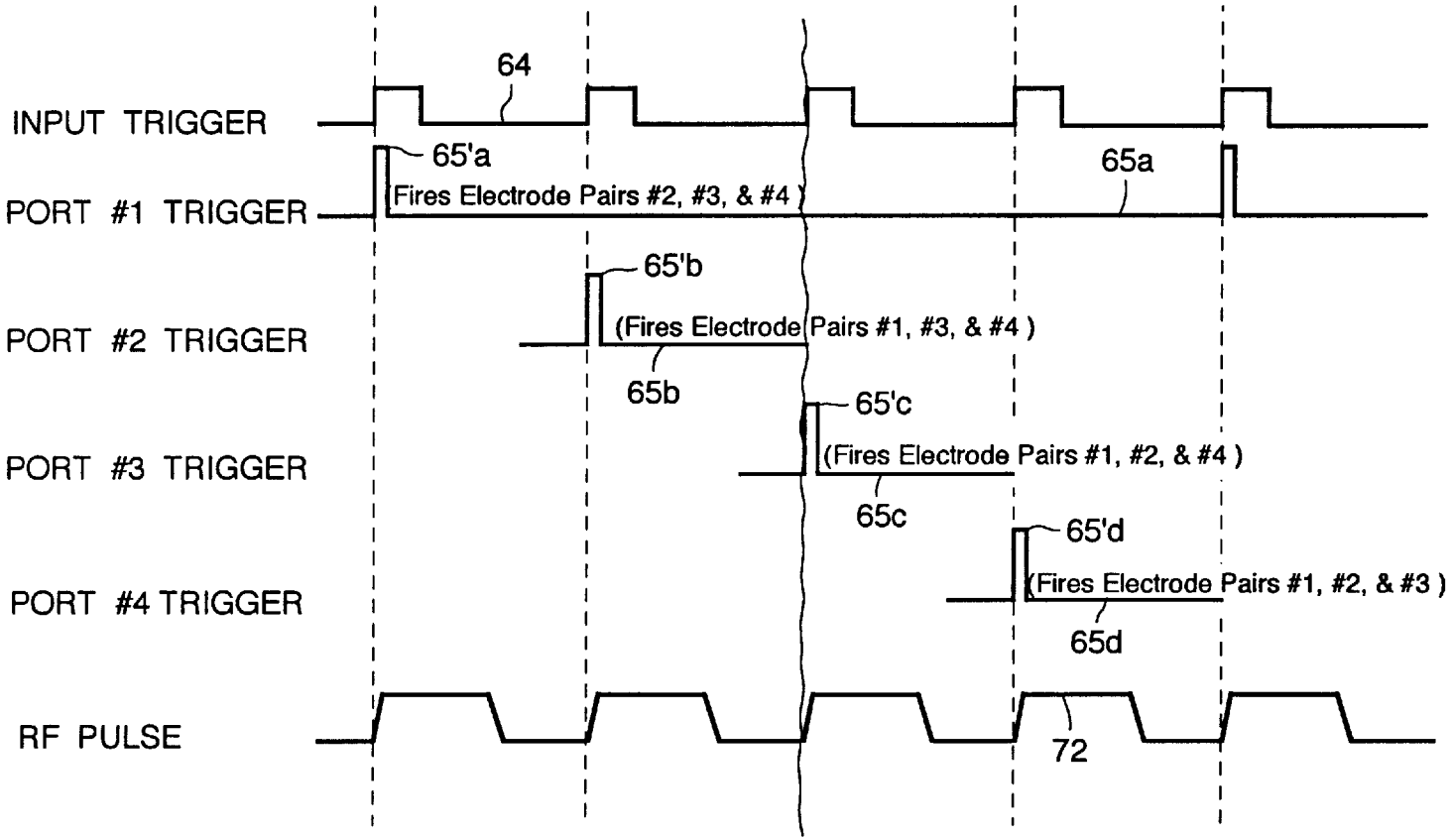
FIG. 6 is a timing diagram for the switching circuit of FIG. 5, when the switching circuit is operated in a scanning mode.

In a typical application, a rapid cycling of the microwave output through the four exit ports is desired, with one microwave beam extracted at a time. FIG. 6 is a timing diagram for the switching circuit 60 for such an application. The input trigger 64, in this case a repetitive pulse train, is supplied to the master controller 62 and to the magnetron 32. The master controller 62 produces the port trigger signals 65*a*, 65*b*, 65*c*, and 65*d*. Each of the port trigger signals activates three of the four microwave barriers, thereby permitting microwave energy to flow through the fourth of the microwave barriers and out of the corresponding exit port. The port trigger signals progress sequentially in the illustrated manner, producing a rotating series of extracted microwave signals from the four exit ports. The input trigger 64 activates the magnetron 32 at each pulse, producing a magnetron output 72 that passes through the selected one of the exit ports. The magnetron output 72 is discontinued just before the switching to the next port occurs.

An important feature of the present approach is that, after the initial triggering of each cycle, the microwave power within the microwave cavity maintains the triggered microwave barriers in their activated state during the remainder of the cycle until the magnetron is turned off, reducing the drive power required in the trigger pulse portion 65' of the port trigger signals 65. As seen in FIG. 6, the trigger pulse 65' in each port trigger signal is of short duration, and specifically much shorter duration than the time during which the RF (radio frequency microwave) pulse is active. The trigger pulse 65' serves to initiate plasma breakdown in each microwave barrier which is activated, but the plasma breakdown within each microwave barrier is thereafter sustained by some of the power from the microwave pulse. The microwave pulse is therefore discontinued for a brief time before the next pulse 65' occurs for another portion of the cycle, to permit the plasma within the active microwave barriers to decay, thereby clearing the microwave barriers for the next portion of the cycle. The input drive power supplied in the trigger pulses 65' is therefore relatively small, allowing the size of the associated power supply to be kept small.

The timing approach of FIG. 6 is preferred in the operation of the microwave launcher 20, to extract a single maximum-power microwave beam at a time from one of the exit ports. However, the use of simultaneous combinations of extracted beams is permitted as well, at the user's discretion. For example, the microwave beam could be extracted from exit ports 34*a* and 34*c*, while preventing extraction from exit ports 34*b* and 34*d* by operation of the respective microwave barriers 38*b* and 38*d*. When the microwave launcher is used in the latter manner, it serves as a selectively controllable microwave beam splitter, inasmuch as the combination of operable exit ports may be rapidly changed.

Figure 7:
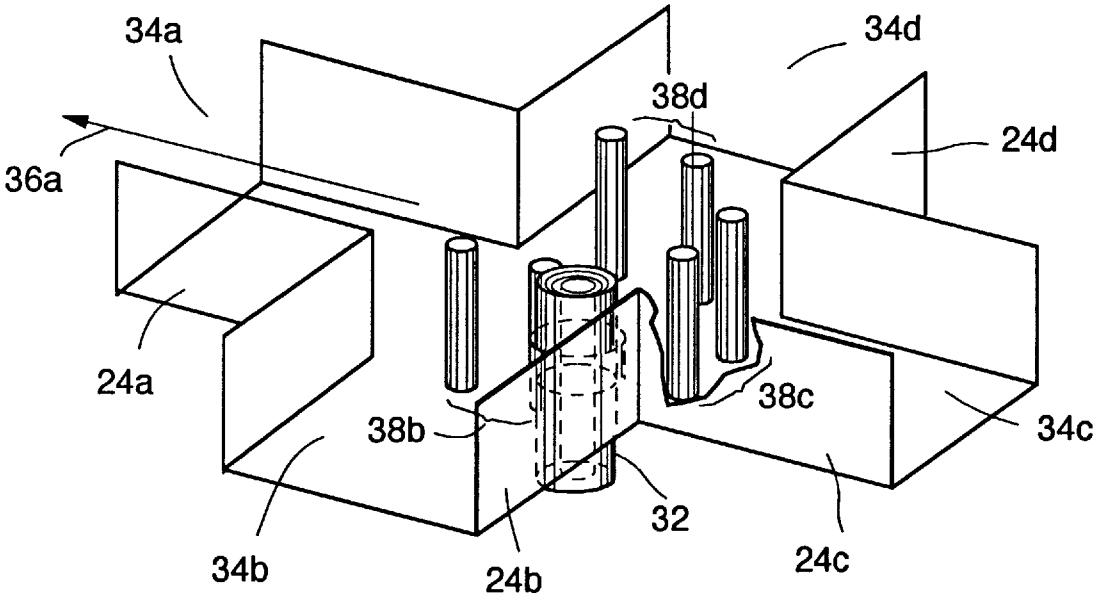
FIG. 7 is a schematic perspective view of the microwave launcher like that of FIG. 2, illustrating the effect of the activation of three of the microwave barriers and non-activation of the fourth microwave barrier.

FIG. 7 schematically illustrates the effective state of the microwave launcher when the exit port 34*a* is selected for extraction of microwave energy, and the ports 34*b*, 34*c*, and 34*d* are blocked by activation of their respective microwave barriers 38*b*, 38*c*, and 38*d*. The pair of cylinders corresponding to the microwave barrier 38*a* is physically present, but is transparent to microwaves and is therefore not illustrated in FIG. 7.

A four-port microwave launcher was built according to the principles discussed herein, for a 75 kW (kilowatt) microwave signal at 915±10 MHz (megahertz). Each arm 24 was 4⅞ inches high and 9¾ inches wide. Mechanical metallic microwave barriers were used in the demonstration. The insertion loss within the microwave cavity was measured as less than 1 dB, and the voltage standing wave ratio was about 2:1. The overall size of the four-port microwave launcher was about 2.5 feet square by 7 inches high, with a weight of about 50 pounds. By comparison, an electromagnetic switch to perform the same four-port switching function is about 6.5 feet by 5 feet by 7 inches in size and weighs about 150 pounds.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A microwave device comprising a microwave source and launcher which couples microwave energy from the source into a selectable at least one of at least two waveguides, the microwave source and launcher including:

a hollow microwave cavity having an entry port and at least two exit ports, wherein the microwave cavity is in the form of a plus sign with ports located in the same plane and 90 degrees apart from each other a single microwave source having a source output in communication with the entry port of the microwave cavity;

a controllable, electrically activated microwave barrier comprising a plasma source at each of the at least two exit ports, each microwave barrier including an electrical signal input whose activation controls the microwave barrier; and a switching circuit including a voltage source for the electrical signal input of each of the microwave barriers.

2. The microwave device of claim 1, wherein the microwave source is a magnetron.

3. The microwave device of claim 1, wherein the entry port is located at the center of the plus sign and perpendicular to the plane of the exit ports.

4. The microwave device of claim 1, wherein the microwave barrier comprises a container, a volume of gas within the container, and an electrode contacting the volume of gas within the container.

5. The microwave device of claim 4, wherein the container is in the form of an elongated hollow body.

6. The microwave device of claim 4, wherein the container is in the form of two flat plates sealed at their edges.

7. The microwave launcher of claim 4, herein the switching circuit comprises a drive circuit for each exit port, each drive circuit including a connection to the electrode of its respective microwave barrier.

8. The microwave device of claim 1, wherein the switching circuit includes means for applying a voltage generated by the voltage source to the electrodes of all but one of the electrical signal inputs at a time.

9. The microwave device of claim 1, wherein each microwave barrier is spaced from the entry port a distance intermediate between an optimum back wall distance for microwave cavity performance and an optimum side wall distance for microwave cavity performance.

10. The microwave device of claim 1, wherein each microwave barrier comprises a first microwave barrier spaced from the entry port a distance equal to an optimum back wall distance for microwave cavity performance, and a second microwave barrier spaced from the entry port a distance equal to an optimum side wall distance for microwave cavity performance.

11. A microwave device comprising a microwave source and launcher which couples microwave energy from the source into a selectable at least one of at least two waveguides, the microwave source and launcher including:

a hollow microwave cavity having at least two planar exit ports and an entry port that is not coplanar with the exit ports, wherein the microwave cavity is in the form of a plus sign with four exit ports located in the same plane and 90 degrees apart from each other;

a single microwave magnetron source having a source output in communication with the entry port of the microwave cavity;

a gas breakdown element at each of the at least two exit ports, each gas breakdown element including a container, a volume of gas within the container, and an electrode contacting the volume of gas within the container; and a switching circuit including a voltage source for the electrode of each of the gas breakdown elements.

12. The microwave device of claim 11, wherein the entry port is located at the center of the plus sign.

13. The microwave device of claim 11, wherein the container is in the form of an elongated hollow body.

14. The microwave device of claim 11, wherein the container is in the form of two flat plates sealed at their edges.

15. The microwave launcher of claim 11, wherein the switching circuit comprises a drive circuit for each exit port, each drive circuit including a connection to the electrode of its respective gas breakdown element.

16. The microwave device of claim 11, wherein the switching circuit includes means for applying a voltage generated by the voltage source to the electrodes of all but one of the gas breakdown elements at a time.

17. The microwave device of claim 11, wherein the container of each gas breakdown element is spaced from the entry port a distance intermediate between an optimum back wall distance for microwave cavity performance and an optimum side wall distance for microwave cavity performance.

18. The microwave device of claim 11, wherein the container of each gas breakdown element is spaced from the entry port a distance equal to an optimum back wall distance for microwave cavity performance, and wherein the microwave device further includes a second gas breakdown element at each of the at least two exit ports, each second gas breakdown element including a second container spaced from the entry port a distance equal to an optimum side wall distance for microwave cavity performance, a volume of gas within the second container, and a second electrode contacting the volume of gas within the second container.

19. A microwave device comprising a microwave source and launcher which couples microwave energy from the source into a selectable at least one of at least two waveguides, the microwave source and launcher including:

a hollow, planar microwave cavity in the form of a plus sign, the microwave cavity comprising a hub, four arms extending from the hub and oriented at 90 degrees to each other, and four exit ports, one exit port in each of the four arms;

an entry port at a center of the hub and perpendicular to the plane of the microwave cavity;

a single microwave magnetron source having a source output in communication with the entry port of the microwave cavity;

four gas breakdown elements within the microwave cavity, one gas breakdown element being disposed within each of the arms, each gas breakdown element comprising a container, a volume of gas within the container, and an electrode contacting the volume of gas within the container; and a switching circuit including a voltage source for the electrode of each of the four gas breakdown elements.

20. The microwave device of claim 19, wherein the switching circuit includes means for applying a voltage generated by the voltage source to the electrodes of exactly three of the four gas breakdown elements at a time.

21. The microwave device of claim 19, wherein the container is in the form of an elongated hollow body.

22. The microwave device of claim 19, wherein the container is in the form of two flat plates sealed at their edges.

23. The microwave device of claim 19, wherein the container of each gas breakdown element is spaced from the entry port a distance intermediate between an optimum back wall distance for microwave cavity performance and an optimum side wall distance for microwave cavity performance.

24. The microwave device of claim 19, wherein the container of each gas breakdown element is spaced from the entry port a distance equal to an optimum back wall distance for microwave cavity performance, and wherein the microwave device further includes a second gas breakdown element at each of the at least two exit ports, each second gas breakdown element including a second container spaced from the entry port a distance equal to an optimum side wall distance for microwave cavity performance, a volume of gas within the second container, and a second electrode contacting the volume of gas within the second container.

25. A microwave device comprising a microwave source and launcher which couples microwave energy from the source into a selectable at least one of at least two waveguides, the microwave source and launcher including:

a hollow microwave cavity having at least two planar exit ports and an entry port that is not coplanar with the exit ports;

a single microwave magnetron source having a source output in communication with the entry port of the microwave cavity;

a gas breakdown element at each of the at least two exit ports, each gas breakdown element including a container, a volume of gas within the container, and an electrode contacting the volume of gas within the container, wherein the container of each gas breakdown element is spaced from the entry port a distance equal to an optimum back wall distance for microwave cavity performance;

a second gas breakdown element at each of the at least two exit ports, each second gas breakdown element including a second container spaced from the entry port a distance equal to an optimum side wall distance for microwave cavity performance, a volume of gas within the second container, and a second electrode contacting the volume of gas within the second container; and a switching circuit including a voltage source for the electrode of each of the gas breakdown elements.

* * * * *